US005507548A

United States Patent [19]

Marhefka

[11] Patent Number: 5,507,548

[45] Date of Patent: Apr. 16, 1996

[54] COLLAPSIBLE CHAIR

[76] Inventor: Matthew D. Marhefka, 853 Second Street Pike, Suite A111, Richboro, Pa. 18954

[21] Appl. No.: 304,353

[22] Filed: Sep. 12, 1994

[51] Int. Cl.[6] ..... A47C 5/10

[52] U.S. Cl. ..... 297/45; 297/59

[58] Field of Search ..... 297/25, 46, 45, 297/59

[56] References Cited

U.S. PATENT DOCUMENTS

| | | | |
|---|---|---|---|
| 4,565,388 | 1/1986 | Kassai | 297/45 X |
| 4,889,383 | 12/1989 | Jones | 297/45 X |
| 5,058,948 | 10/1991 | Singer | 297/25 X |
| 5,358,263 | 10/1994 | Aldus et al. | 297/45 X |

FOREIGN PATENT DOCUMENTS

| | | | |
|---|---|---|---|
| 525926 | 6/1956 | Canada | 297/45 |
| 1142576 | 9/1957 | France | 297/45 |

*Primary Examiner*—Peter R. Brown

*Attorney, Agent, or Firm*—Norman E. Lehrer; Jeffrey S. Ginsberg

[57] ABSTRACT

A collapsible chair includes a pair of intercrossing frames pivotally interconnected at front and rear pivot points. A pair of curved back support rods extend upwardly from the frames. A back rest is secured on and between the curved back support rods and a seat extends perpendicularly from the bottom of the back rest when the chair is in the upright condition. Each of the back support rods is rotatably secured to the intercrossing frames so that the back support rods can be positioned side-by-side when the chair is in the folded condition.

11 Claims, 2 Drawing Sheets

COLLAPSIBLE CHAIR

BACKGROUND OF THE INVENTION

The present invention is directed toward a collapsible chair of the type commonly referred to as a director's chair and, more particularly, to such a chair having a relatively flat profile when in the folded condition.

Collapsible or foldable chairs are well known in the art. The folding feature is desirable for both storing and transporting the chairs. A problem with most existing collapsible chairs is that even when in their folded condition they still tend to be cumbersome and, therefore, are not well suited for packaging, shipping or transportation. U.S. Pat. No. 3,492,046, for example, discloses a series of laterally arranged folding chairs that can be separated into individual units. When an individual chair is placed in the folded condition, the upper portions of the back frame members cross one another. Accordingly, the individual base frame members do not lie in one flat plane when folded.

Another problem with existing foldable chairs is that they are both difficult and expensive to manufacture. This is attributed to the fact that they are made of a large number of interconnected pieces. Such chairs are shown, for example, in U.S. Pat. Nos. 4,118,065 and 4,437,700. In each of these patents, a chair is disclosed that is comprised of a number of pieces interconnected at various points.

Accordingly, there is a need for a collapsible director's chair that can fold to a substantially flat profile for convenient storage and/or transportation. Furthermore, there is a need for such a chair that is both easy and relatively inexpensive to manufacture.

SUMMARY OF THE INVENTION

The present invention is designed to overcome the deficiencies of the prior art discussed above. It is an object of this invention to provide a sturdy collapsible chair that comprises a limited number of different cooperating components to facilitate the production of the same.

It is a further object to provide a collapsible chair that has a relatively flat profile when in the folded condition to facilitate storage and transportation.

It is yet another object to provide a chair having seat and back rest elements that can comfortably support a person in the seated position.

It is still another object to provide a chair that can be readily collapsed from an upright position to a folded position.

In accordance with the illustrative embodiments, demonstrating features and advantages of the present invention, there is provided a collapsible chair which includes a pair of intercrossing frames pivotally interconnected at front and rear pivot points, a pair of curved back support rods extending upwardly from said frames, a back rest secured on and between the curved back support rods and a seat extending perpendicularly from the bottom of the back rest when the chair is in the upright condition. Each back support rod is rotatably secured to the intercrossing frames so that the rods can be positioned side-by-side when the chair is in the folded condition.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE DRAWINGS

Figure 1:
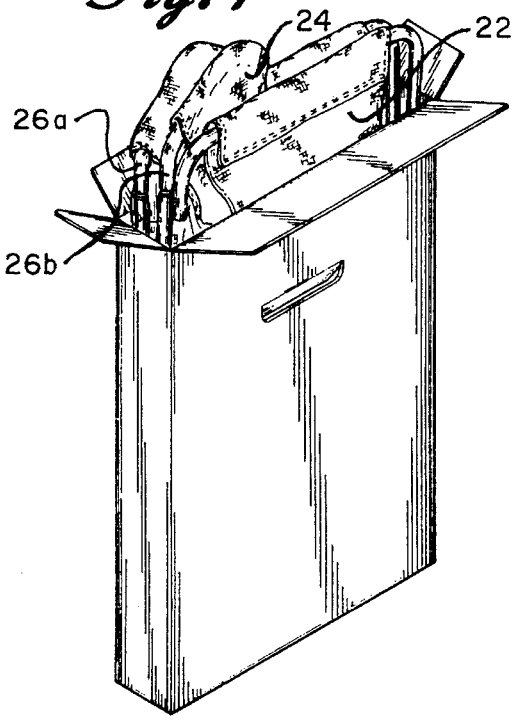
FIG. 1 is a perspective view of the collapsible chair in the folded condition constructed in accordance with the principles of the present invention and inserted into a box.

Referring now to the drawings in detail wherein like reference numerals have been used throughout the various figures to designate like elements, there is shown in FIGS. 1–5 a collapsible chair constructed in accordance with the principles of the present invention and designated generally as 10.

The collapsible chair 10 includes a pair of identical rectangular intercrossing frames 12*a* and 12*b* pivotally connected at front and rear pivot points 15 and 17, respectively. The frames are preferably connected at the pivot points by a nut and bolt or rivet type fastener extending through appropriately sized holes in each of the frames. Each frame member comprises an upper elongated horizontal member 14*a* and 14*b*, a lower elongated horizontal member 16*a* and 16*b*, a front vertical or diagonal member 18*a* and 18*b* and a rear vertical or diagonal member 20*a* and 20*b*. The upper elongated horizontal member 14*a* has a downwardly extending portion 13*a* and the upper elongated horizontal member 14*b* has a downwardly extending portion 13*b*. Preferably, the frames are fabricated from a relatively strong lightweight material, such as tubular aluminum or stainless steel or other suitable alloy. However, other materials such as polyvinyl chloride can be utilized.

Figure 2:
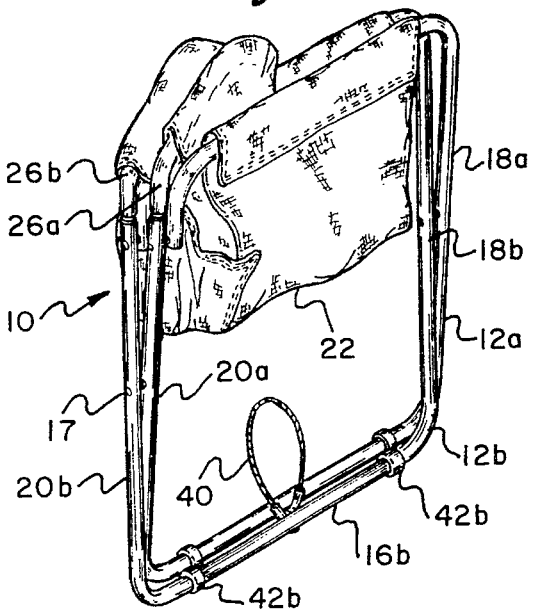
FIG. 2 is a perspective view of the collapsible chair in the folded condition.
Figure 3:
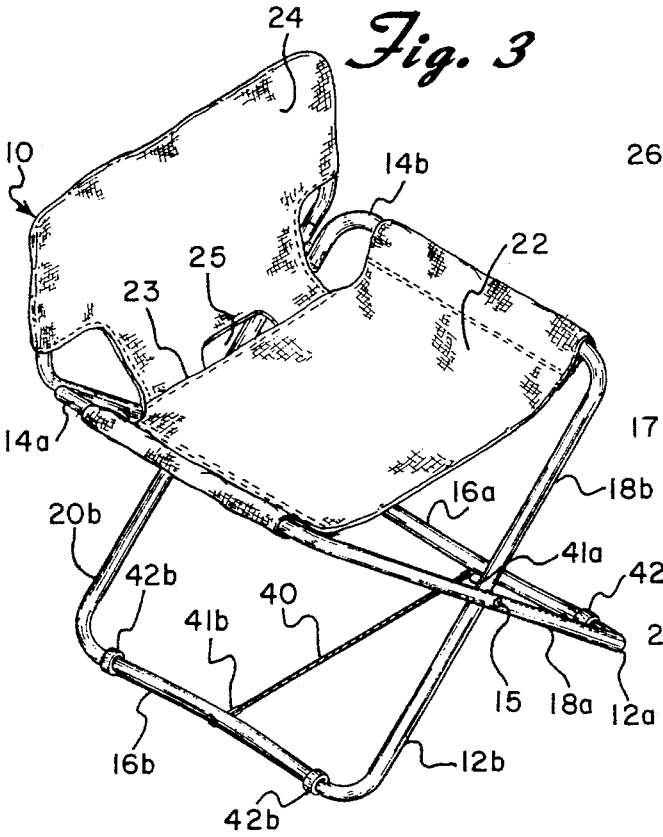
FIG. 3 is a perspective view of the collapsible chair in the upright condition.
Figure 4:
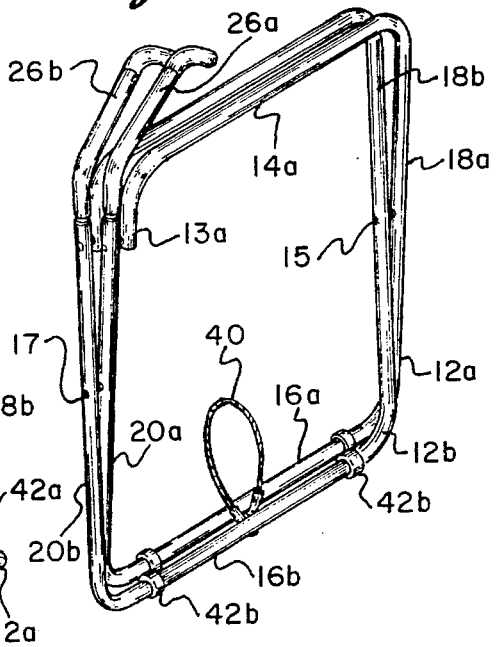
FIG. 4 is a perspective view of the collapsible chair in the folded condition similar to FIG. 2 but without the seat and back rest.

The frames are capable of swinging movement about the front and rear pivot points 15 and 17 along a common axis to move from an upright position, in which upper elongated members 14*a* and 14*b* are laterally spaced apart (FIGS. 3 and 5), to a folded position, in which said upper members are substantially side-by-side (FIGS. 2 and 4).

Figure 5:
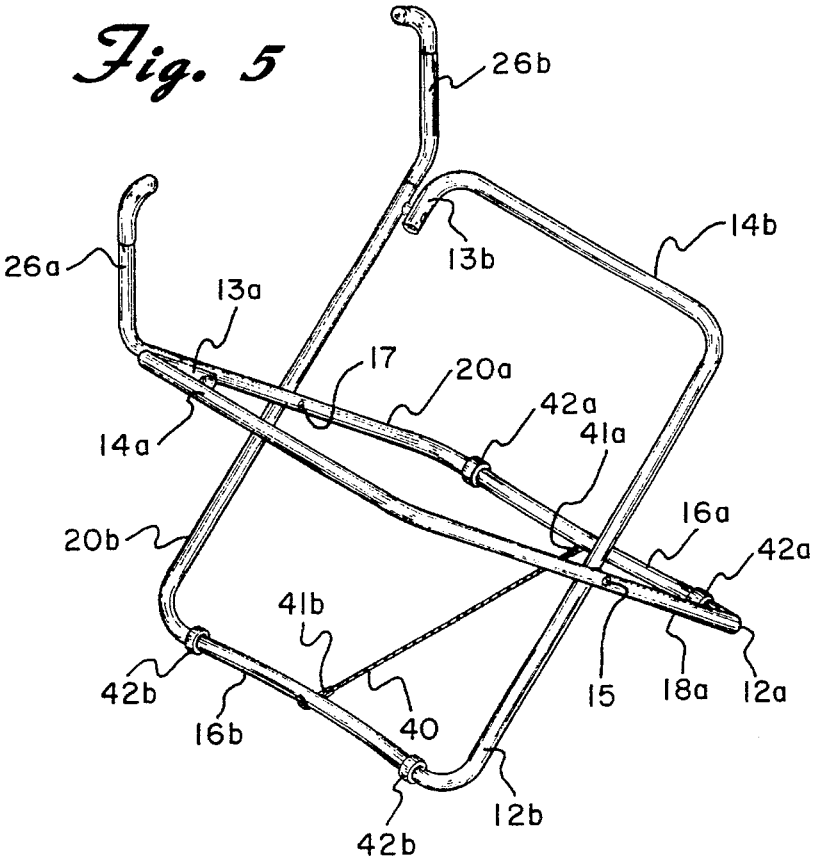
FIG. 5 is a perspective view of the collapsible chair in the upright condition similar to FIG. 3 but without the seat and back rest.

Referring to FIG. 5, the chair includes a pair of curved back support rods 26*a* and 26*b*. In the preferred embodiment, each of the back support rods 26*a* and 26*b* has a straight first section and a curved second section. The straight first section of each of the support rods is connected to and extends in axial alignment with a corresponding one of the rear tubular members 20*a* and 20*b* and is rotatable relative thereto about a point substantially at the interconnection between the first section and the rear tubular member so that the back support rods can be placed substantially side-by-side when the chair is in the folded position. Each of the curved second sections of the support rods 26*a* and 26*b* extends upwardly from a corresponding one of the first sections of the back support rods. As shown in FIG. 3, a back rest 24 is secured on and between the curved back support rods 26*a* and 26*b* and a seat 22 extends forwardly from the bottom 23 of the back rest 24 when the chair is in the upright condition. The back rest has an opening 25 formed in the bottom thereof. The opening 25 increases the lumbar support provided by the back rest 24 when the occupant is seated in the chair near the opening.

The back rest 24 also has a pair of side openings through which the back support rods 26*a* and 26*b* extend. The upper elongated members 14*a* and 14*b* extend within corresponding elongated openings formed along the sides of seat 22. The back rest 24 and seat 22 are preferably made of a canvas material. However, both the back rest and seat can be made of other materials such as leather or vinyl coated nylon mesh.

In the preferred embodiment, back support rods 26*a* and 26*b* are rotatably secured in a corresponding rear tubular member 20*a* or 20*b* of the frames 12*a* and 12*b*. The back support rods 26*a* and 26*b* are preferably identical to each other. Accordingly, only one of the back support rods will be described in detail; it being understood that the description applies equally to the other back support rod.

Figure 6:
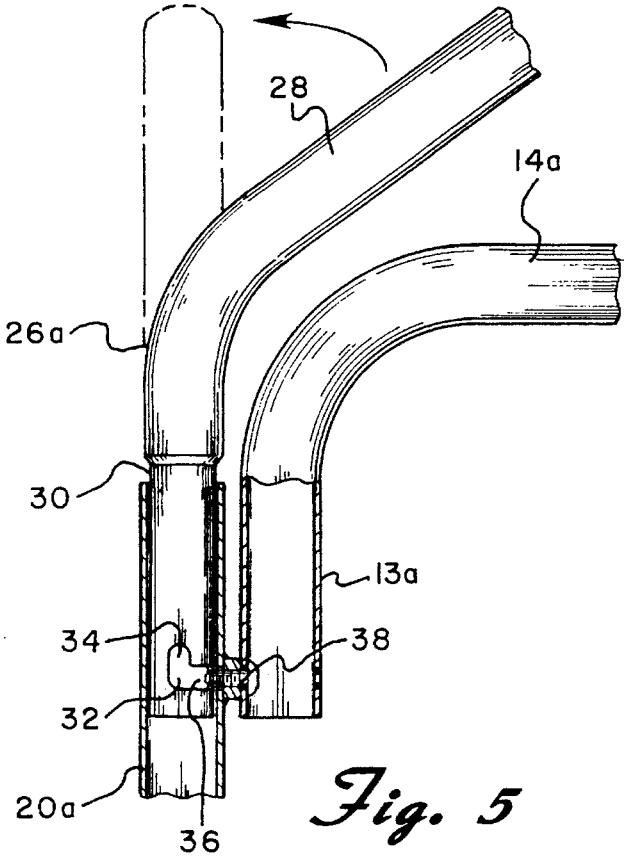
FIG. 6 is a partial cross-sectional view of a back support rod secured in a rear tubular member of one of the frames.
Figure 7:
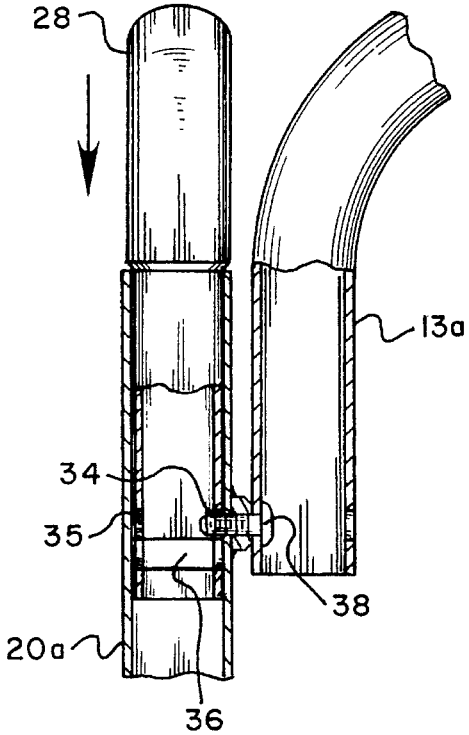
FIG. 7 is a partial cross-sectional view of a back support rod secured in a rear tubular member of one of the frames similar to FIG. 6 but with the rod in a different position.

As best seen in FIGS. 6 and 7, back support rod 26*a* has a large diameter segment 28 and a reduced diameter segment 30. A slot 32 is formed in the wall of the reduced diameter segment. The slot 32 has a pair of axially extending portions 34 and 35 that are spaced 180° apart from each other and an arcuately extending portion 36 positioned between and extending from the bottom of the axially extending portions 34 and 35.

The reduced diameter segment 30 is inserted in the top of rear tubular member 20*a*. A screw 38 is inserted through the downwardly extending portion 13*a* of upper horizontal member 14*a* and through the rear tubular member 20*a* and into the slot 32. The screw 38 can be positioned in one of the axially extending portions 34 or 35 or in the arcuately extending portion 36 in the manner described below. When screw 38 is positioned in the arcuately extending portion 36 of slot 32, the support rod 26*a* is free to rotate about rear tubular member 20*a*. Conversely, when screw 38 is positioned in one of the axially extending portions 34 or 35, the back support rod 26*a* is locked in place in the rear tubular member 20*a*.

The axially extending portions 34 and 35 are preferably spaced from one another so that support rod 26*a* can rotate 180° in slot 32 when screw 38 is positioned in the arcuately extending portion 36. The screw 38 is secured in axially extending portion 34 when the chair is in its upright position. Although, only the attachment of support rod 26*a* in rear tubular member 20*a* has been described in detail, it should be understood that the description applies equally to the attachment of support rod 26*b* in rear tubular member 20*b*.

A security cable 40 is attached between the lower elongated members 16*a* and 16*b* to prevent the pivotally interconnected frames 12*a* and 12*b* from separating beyond the length of the cable. Cable connecting means 41*a* and 41*b* connect the different ends of the cable to a corresponding lower elongated member 16*a* and 16*b* as shown in FIGS. 3 and 5. A screw (not shown) is threaded through cable connecting means 41*a* and into lower elongated member 16*a* to secure the cable connecting means 41*a* to the frame 12*a*. Cable connecting means 41*b* is similarly connected to lower elongated member 16*b*. The length of security cable 40 is preferably somewhat less than the length of the back rest 24 and the seat 22. This allows the back rest 24 and the seat 22 to be slightly relaxed between rods 26*a* and 26*b* and members 14*a* and 14*b*, respectively, in order to increase both the comfort and appearance of the chair 10.

In the preferred embodiment, the lower elongated members 16*a* and 16*b* are equipped with a pair of foot rings 42*a* and 42*b*, respectively, to provide a non-slip surface with the ground.

To facilitate an understanding the principles associated with the foregoing apparatus, its operation will now be briefly described. In the folded condition, the upper elongated members 14*a* and 14*b* and the lower elongated members 16*a* and 16*b* of the frame members 12*a* and 12*b* are substantially side-by-side as shown in FIG. 2. Back support rod 26*a* is rotatably secured in rear tubular member 20*a* as the screw 38 is positioned in the arcuately extending segment 36 of slot 32 as shown in FIG. 6. Back support rod 26*b* is similarly secured in rear tubular member 20*b*.

Back support rods 26*a* and 26*b* are also substantially side-by-side in the folded condition as shown in FIG. 4. Accordingly, the chair is folded into a relatively flat profile so that it can be conveniently stored or transported by placing the same in a box as illustrated in FIG. 1.

In order to sit in the collapsible chair it must be converted from the folded or collapsed position (see FIG. 2) to an upright position (see FIG. 3). This is most easily accomplished by physically separating upper and lower elongated members 14*a* and 14*b* and 16*a* and 16*b*, respectively. As the aforementioned members are separated, the back rest 24 and seat 22 are extended. When security cable 40 becomes taut, further separation is prevented. Back support rods 26*a* and 26*b* are then rotated in the rear tubular members 20*a* and 20*b* until they extend toward one another as shown in FIG. 5. The rods rotate to their proper position automatically because of the action of the back rest 24. Because the back rest 24 is not taut, the back support rods 26*a* and 26*b* also drop into their locked position automatically from the force of gravity.

To secure the back support rods 26*a* and 26*b* in place so that the back rest remains relatively extended when in the upright position, the back support rods are locked in place. Although only the securement of back support rod 26*a* in rear tubular member 20*a* will be described in detail, it should be understood that back support rod 26*b* is similarly secured in rear tubular member 20*a*. Axially extending portion 34 of slot 32 is aligned with screw 38 by rotating the back support rod 26*a* about slot 32. The back support rod 26*a* is further inserted into rear tubular member 20*a* and the screw 38 enters the axially extending portion 34. The axially extending portion 34 then prevents further rotation of the back support rod 26*a*.

The collapsible chair can be converted back to the folded position in the following manner. Back support rod 26*a* is lifted so that the reduced diameter segment 30 moves slightly up rear tubular member 20*a* and the screw 38 enters the arcuately extending portion 36. The back support rod is then rotated clockwise so that it essentially lies in the plane of the frame 12*a*. Back support rod 26*b* is similarly positioned. The upper and lower elongated members 14*a* and 14*b* and 16*a* and 16*b* respectively, are then moved together until they are once again substantially side-by-side. The chair is then ready for storage and/or transportation.

The present invention may be embodied in other specific forms without departing from the spirit or essential attributes thereof and accordingly reference should be made to the appended claims rather than to the foregoing specification as indicating the scope of the invention.

I claim:

1. A collapsible chair for supporting a person in a sitting position comprising:

a pair of transversely intercrossing rectangular frames pivotally interconnected at front and rear pivot points, each of said frames including upper and lower elongated horizontal members and front and rear tubular members, said frames being capable of pivotal movement about said front and rear pivot points along a common axis to move from an upright position in which said upper members are laterally spaced apart, to a folded position in which said upper members are substantially side-by-side;

a flexible seat secured on and between said upper elongated members of said frames, said seat being substantially extended when said chair is in said upright position;

a pair of curved back support rods extending upwardly from said rear tubular members and being rotatable relative thereto about a point located below said upper elongated horizontal members so that said back support rods can be placed substantially side-by-side when said chair is in said folded position, and a back rest secured on and between said back support rods above said upper elongated horizontal members.

2. The collapsible chair of claim 1 further including means for prohibiting rotation of said back support rods beyond a predetermined amount, said prohibiting means including:

said back support rods having a large diameter segment and a reduced diameter segment, said reduced diameter segments being rotatably mounted in said rear tubular members of said frames and having a slot formed therein, said slots having an arcuately extending portion, and a pair of screws inserted through said rear tubular members and into said slots in said reduced diameter segments of said back support rods so that rotation of said curved support rods is prohibited when said screws encounter the ends of said arcuately extending portions of said slots.

3. The collapsible chair of claim 2 wherein said slots further have an axially extending portion, said back support rods being locked in place when said screws are in said axially extending portions of said slots.

4. The collapsible chair of claim 3 wherein said locking means comprises:

said slots further having an axially extending portion, said back support rods being locked in place when said screws are in said axially extending portions of said slots.

5. The collapsible chair of claim 4 wherein said back rest has an opening formed in the bottom thereof.

6. The collapsible chair of claim 5 wherein said flexible seat and said back seat are connected.

7. The collapsible chair of claim 3 wherein said support rods being rotatably secured to said rear tubular members so that when said chair is in said folded position said support rods can be positioned adjacent one another.

8. The collapsible chair of claim 3 wherein said seat and said back support are of the sling seat variety.

9. The collapsible chair of claim 3 further comprising a security cable connected between said lower elongated members of said frames for preventing the separation between said lower elongated members beyond a predetermined distance.

10. The collapsible chair of claim 3 further comprising a pair of foot rings positioned on each of said lower elongated members of said frames for providing a non-slip surface with the ground.

11. A collapsible chair for supporting a person in a sitting position comprising:

a pair of transversely intercrossing rectangular frames pivotally interconnected at front and rear pivot points, each of said frames including upper and lower elongated horizontal members and front and rear diagonally extending straight tubular members, said frames being capable of pivotal movement about said front and rear pivot points along a common axis to move from an upright position in which said upper members are laterally spaced apart, to a folded position in which said upper members are substantially side-by-side;

a flexible seat secured on and between said upper elongated members of said frames, said seat being substantially extended when said chair is in said upright position;

a pair of back support rods, each of said back support rods having a straight first section and a curved second section, the straight first section of each of said support rods being connected to and extending in axial alignment with a corresponding one of said rear tubular members and being rotatable relative thereto about a point substantially at the interconnection between said first section and said rear tubular member so that said back support rods can be placed substantially side-by-side when said chair is in said folded position, each of said curved second sections of said support rods extending upwardly from a corresponding one of said first sections of said back support rods, and a back rest secured on and between said back support rods.

* * * * *